US008660851B2

(12) United States Patent
Yamanashi et al.

(10) Patent No.: US 8,660,851 B2
(45) Date of Patent: Feb. 25, 2014

(54) STEREO SIGNAL DECODING DEVICE AND STEREO SIGNAL DECODING METHOD

(75) Inventors: Tomofumi Yamanashi, Kanagawa (JP); Masahiro Oshikiri, Kanagawa (JP); Hiroyuki Ehara, Kanagawa (JP)

(73) Assignee: Panasonic Corporation, Osaka (JP)

( * ) Notice: Subject to any disclaimer, the term of this patent is extended or adjusted under 35 U.S.C. 154(b) by 126 days.

(21) Appl. No.: 13/322,202

(22) PCT Filed: May 25, 2010

(86) PCT No.: PCT/JP2010/003496

§ 371 (c)(1),
(2), (4) Date: Nov. 23, 2011

(87) PCT Pub. No.: WO2010/137300

PCT Pub. Date: Dec. 2, 2010

(65) Prior Publication Data

US 2012/0065984 A1 Mar. 15, 2012

(30) Foreign Application Priority Data

May 26, 2009 (JP) ..... 2009-126615

(51) Int. Cl.
*G10L 19/008* (2013.01)

(52) U.S. Cl.
USPC ..... 704/500

(58) Field of Classification Search
USPC ..... 704/500
See application file for complete search history.

(56) References Cited

U.S. PATENT DOCUMENTS

| | | | |
|---|---|---|---|
| 5,136,649 | A | 8/1992 | Ishikawa et al. |
| 2005/0182996 | A1 | 8/2005 | Bruhn |
| 2009/0094024 | A1 | 4/2009 | Yamanashi et al. |
| 2009/0281811 | A1 | 11/2009 | Oshikiri et al. |
| 2010/0017198 | A1 | 1/2010 | Yamanashi et al. |
| 2010/0017199 | A1 | 1/2010 | Oshikiri et al. |
| 2010/0017200 | A1 | 1/2010 | Oshikiri et al. |
| 2010/0017204 | A1 | 1/2010 | Oshikiri et al. |
| 2010/0049512 | A1 | 2/2010 | Oshikiri et al. |
| 2010/0057446 | A1 | 3/2010 | Morii et al. |
| 2010/0106496 | A1 | 4/2010 | Morii et al. |
| 2010/0169081 | A1 | 7/2010 | Yamanashi et al. |
| 2010/0274558 | A1 | 10/2010 | Yamanashi et al. |
| 2010/0280822 | A1 | 11/2010 | Yoshida |
| 2010/0280833 | A1 | 11/2010 | Yamanashi et al. |
| 2010/0284455 | A1 | 11/2010 | Yamanashi et al. |
| 2010/0332221 | A1 | 12/2010 | Yamanashi et al. |

FOREIGN PATENT DOCUMENTS

| | | |
|---|---|---|
| JP | 2-309832 | 12/1990 |
| JP | 2005-130074 | 5/2005 |
| JP | 2007-529020 | 10/2007 |
| WO | 2009/084226 | 7/2009 |

*Primary Examiner* — Susan McFadden
(74) *Attorney, Agent, or Firm* — Greenblum & Bernstein, P.L.C.

(57) ABSTRACT

A decoding device reduces abrupt changes in the number of channels in a decoded signal when transmission errors occur as a result of lost frames in an encoding/decoding system for multichannel signals. In the device, a demultiplexer receives an encoded monaural signal and an encoded differential signal and detects change over time in the received encoded differential signal. An M signal decoder decodes the encoded monaural signal and obtains a decoded monaural signal. An S signal decoder decodes the encoded differential signal and obtains a decoded differential signal. A smoothing unit performs smoothing on the decoded differential signal by means of a computation involving the decoded differential signal and coefficients corresponding to the change over time detected by the demultiplexer. An L/R signal computation unit computes a decoded stereo signal from the decoded monaural signal and the smoothed decoded differential signal.

10 Claims, 9 Drawing Sheets

STEREO SIGNAL DECODING DEVICE AND STEREO SIGNAL DECODING METHOD

TECHNICAL FIELD

The present invention relates particularly to a decoding apparatus and decoding method used in a communication system for encoding a signal and transmitting, receiving, and decoding the encoded signal.

BACKGROUND ART

When speech/music signals are transmitted using a mobile communication system or a packet communication system represented by Internet communication, compression/encoding techniques are used to improve transmission efficiency of the speech/music signals. Recently, there are increasing needs for techniques capable of encoding multi-channel speech/music signals such as stereo signals as well as monaural signals even though speech/music signal is being encoded at a low bit rate.

For example, as a technique of encoding two-channel signals (stereo signals) including a left channel signal (hereinafter, referred to as an L signal) and a right channel signal (hereinafter, referred to as an R signal), there are known background arts such as a middle/side (M/S) stereo encoding scheme and an intensity stereo encoding scheme. Here, the M/S encoding scheme will be described shortly. In the M/S encoding scheme, a signal which is correlated between the channels being removed is generated by converting two-channel signals of the L signal and the R signal into a multiplication signal (hereinafter, referred to as an M signal) between the L signal and the R signal and a subtraction signal (hereinafter, referred to as an S signal) between the L signal and R signal. In the M/S encoding scheme, the signals are encoded after the correlation between the channels is removed from the signals. As a result, it is possible to perform encoding efficiently by reducing the redundant information contained in the two-channel signal prior to the conversion. In addition, there is a known technique called a parametric stereo encoding scheme which uses the correlation between the two-channel signals of the L and the R signals. In the parametric stereo encoding scheme, the two-channel signal including the L signal and the R signal is represented according to a one-channel signal and a parameter indicating a relationship between the channels. The one-channel signal and the parameter for expanding the channels signal are encoded.

In addition, various techniques have been developed up to now for a process of suppressing sound quality deterioration caused when an erroneous transmission occurs in a multi-channel encoding/decoding scheme.

Patent Literature 1 discloses a technique of suppressing the allophone caused by an abrupt change in the number of channels in the decoded signal when frame loss is generated by a transmission error and the like in the multi-channel signal parametric encoding scheme. Specifically, in Patent Literature 1, when the frame loss occurs, a process for generating a substitution signal for the wrong parts based on the stored parameter relating to the signal having no fault is performed. Patent Literature 1 discloses a process of applying stepwise muting of the model parameter when the defective frames are continued in series.

CITATION LIST

Patent Literature

PTL 1
Japanese Patent Application National Publication (Laid-Open) No. 2007-529020

SUMMARY OF INVENTION

Technical Problem

However, Patent Literature 1 fails to disclose a process of suppressing sound quality deterioration when the frame is lost in the M/S encoding scheme, which is the non-parametric encoding/decoding scheme, and the M/S encoding scheme still suffers sound quality deterioration when the frame is lost. In Patent Literature 1, since a concealment process is performed for erroneous frames at a parameter level, it is difficult to conceal for spatial characteristics other than those corresponding to that parameter with high precision, and the performance of suppressing the sound quality deterioration is insufficient. In Patent Literature 1, because stepwise muting at the parameter level is performed for each frame, it is difficult to perform muting in detail in the unit of sample.

An object of the present invention is to provide, for example, a decoding apparatus and a decoding method capable of alleviating an abrupt change in the number of channels in the decoding signal, and smoothing the decoded signals in the unit of sample, and suppressing sound quality deterioration in a case where a transmission error occurs owing to frame loss in the multi-channel encoding/decoding scheme such as an M/S encoding/decoding scheme.

Solution to Problem

A decoding apparatus according to the present invention employs a configuration to include: a reception section that receives an encoded monaural signal obtained by encoding a monaural signal computed from first and second channel signals of a stereo signal and an encoded difference signal obtained by encoding a difference signal between the first and second channel signals; a detection section that detects a variation over time of the received encoded difference signal; a decoding section that decodes the received encoded monaural signal to obtain the decoded monaural signal and decodes the received encoded difference signal to obtain the decoded difference signal; a smoothing section that smoothes the decoded difference signal by an operation of the decoded difference signal and a coefficient corresponding to the detected variation over time; and a computation section that computes the decoded stereo signal from the decoded monaural signal and the decoded difference signal obtained by smoothing.

A decoding method according to the present invention employs a configuration to include the steps of: receiving an encoded monaural signal obtained by encoding a monaural signal computed from first and second channel signals of a stereo signal and an encoded difference signal obtained by encoding a difference signal between the first and second channel signals; detecting a variation over time of the received encoded difference signal; decoding the received encoded monaural signal to obtain the decoded monaural signal and decoding the received encoded difference signal to obtain the decoded difference signal; smoothing the decoded difference signal by an operation of the decoded difference signal and a coefficient corresponding to the detected variation over time; and computing a decoded stereo signal from the decoded monaural signal and the decoded difference signal subjected to smoothing.

Advantageous Effects of Invention

According to the present invention, for example, in the multi-channel signal encoding/decoding scheme such as an M/S encoding/decoding scheme, when a transmission error occurs owing to frame loss, it is possible to alleviate an abrupt change in the number of channels in the decoded signals and smooth the decoded signals in the unit of sample, in order to suppress sound quality deterioration.

DESCRIPTION OF EMBODIMENTS

Embodiment 1

Figure 1:
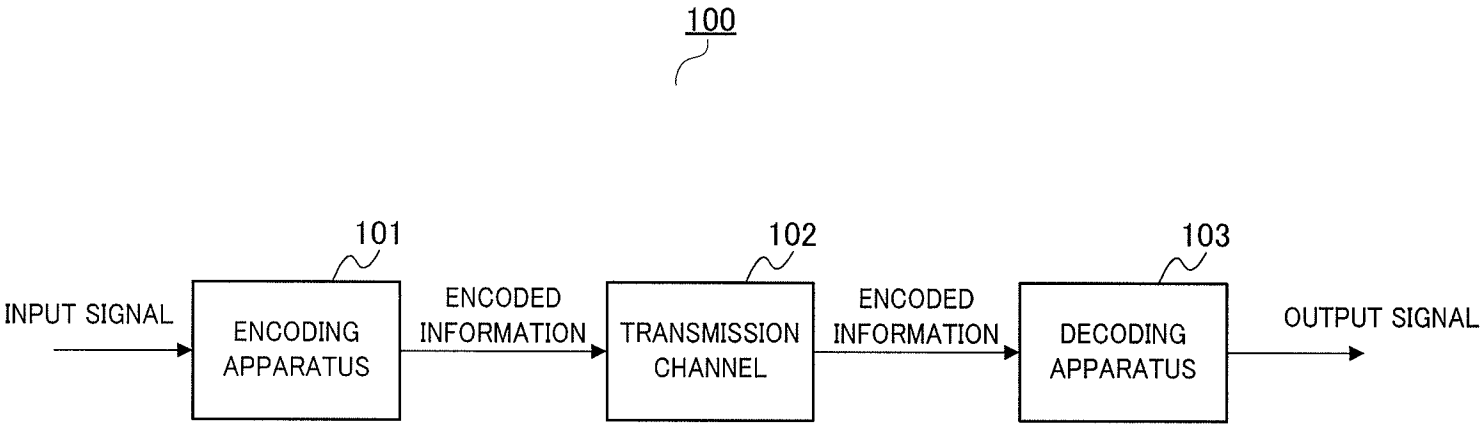
FIG. 1 is a block diagram illustrating a configuration of the communication system according to Embodiment 1 of the present invention.

FIG. 1 is a block diagram illustrating a configuration of communication system 100 according to Embodiment 1 of the present invention. Communication system 100 includes encoding apparatus 101, transmission channel 102, and decoding apparatus 103. In communication system 100, encoding apparatus 101, and decoding apparatus 103 are able to communicate with each other through transmission channel 102. In addition, both encoding apparatus 101 and decoding apparatus 103 are typically mounted and used in a base station apparatus, a communication terminal apparatus, or the like. Hereinafter, each configuration will be described specifically.

A description will be exemplarily made for a configuration in which encoding apparatus 101 encodes each of the L signal and the R signal as input signals using a code exited linear prediction (CELP) scheme. Encoding apparatus 101 obtains encoded information by encoding the L and R signals and transmits the obtained encoded information to decoding apparatus 103 through transmission channel 102. In addition, the configuration of encoding apparatus 101 will be described in more detail below.

Decoding apparatus 103 receives the transmitted encoded information from encoding apparatus 101 through transmission channel 102 and obtains the decoded L and R signals as the output signals by decoding the received encoded information. In addition, decoding apparatus 103 describes, for example, the configuration decoding the same as encoding apparatus 101 in the CELP decoding scheme. In addition, the configuration of decoding apparatus 103 will be described in more detail below.

Hereinbefore, a description has been made for the configuration of communication system 100.

Figure 2:
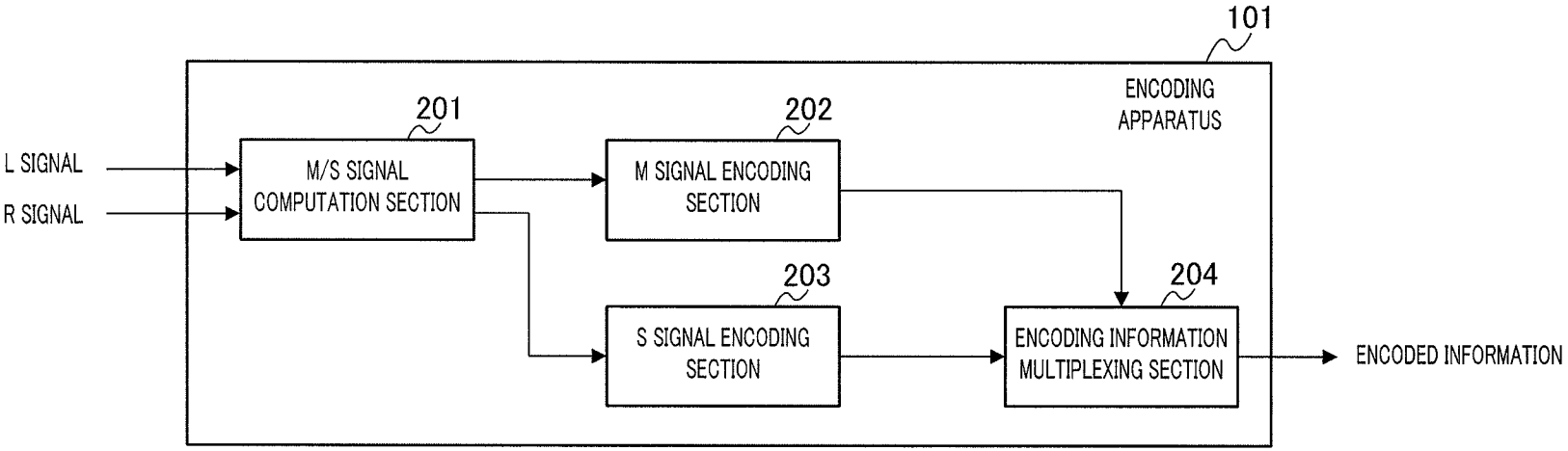
FIG. 2 is a block diagram illustrating a configuration of the encoding apparatus according to Embodiment 1 of the present invention.

Next, a configuration of encoding apparatus 101 will be described with reference to FIG. 2. FIG. 2 is a block diagram illustrating a configuration of encoding apparatus 101.

Encoding apparatus 101 includes M/S signal computation section 201, M signal encoding section 202, S signal encoding section 203, and encoded information multiplexing section 204.

Encoding apparatus 101 receives the two-channel signal of the L and R signals, converts the received L and R signals into M and S signals, and then, obtains encoded information by encoding each of the M and S signals. Encoding apparatus 101 multiplexes each piece of the obtained encoded information by using encoded information multiplexing section 204 and transmits the multiplexed encoded information to decoding apparatus 103. Hereinafter, each configuration will be described in detail.

M/S signal computation section 201 receives the L signal and R signal and computes a multiplication signal (M signal) and a subtraction signal (S signal) based on equations 1 and 2 as follows. Here, i of equations 1 and 2 denotes a sample index of the frame, and N denotes a frame size.

(Equation 1)

$$M_i = \frac{(L_i + R_i)}{2} \quad (i = 0, \ldots, N-1) \qquad [1]$$

(Equation 2)

$$S_i = \frac{(L_i - R_i)}{2} \quad (i = 0, \ldots, N-1) \qquad [2]$$

M/S signal computation section 201 outputs the M signal computed using equation 1 to M signal encoding section 202 and outputs the S signal computed using equation 2 to S signal encoding section 203.

M signal encoding section 202 receives the M signal from M/S signal computation section 201 and encodes the M signal based on the CELP speech encoding scheme and computes the M encoded information. Then, M signal encoding section 202 outputs the computed M encoded information to encoded information multiplexing section 204.

S signal encoding section 203 receives the S signal from M/S signal computation section 201 and encodes the S signal based on the CELP speech encoding scheme and computes the S encoded information. Then, S signal encoding section 203 outputs the computed S encoded information to encoded information multiplexing section 204. Since the CELP speech encoding scheme is already known in the art, detailed description thereof will not be repeated.

Encoded information multiplexing section 204 receives the M encoded information from M signal encoding section 202 and receives the S encoded information from S signal encoding section 203. Encoded information multiplexing section 204 multiplexes the received S encoded information and the M encoded information to obtain encoded information. Encoded information multiplexing section 204 outputs the obtained encoded information to transmission channel 102. Hereinbefore, a description has been made for the configuration of encoding apparatus 101.

Figure 3:
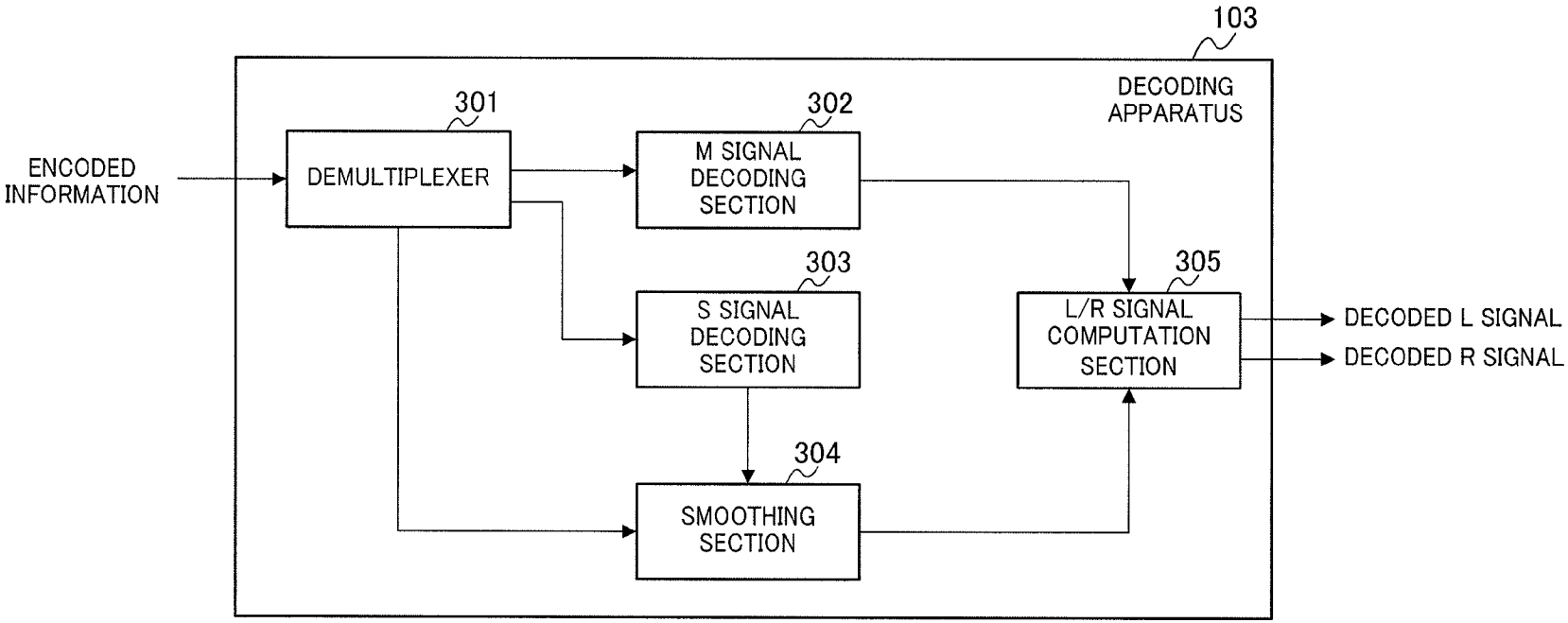
FIG. 3 is a block diagram illustrating a configuration of the decoding apparatus according to Embodiment 1 of the present invention.

Next, a configuration of decoding apparatus 103 will be described with reference to FIG. 3. FIG. 3 is a block diagram illustrating a configuration of decoding apparatus 103.

Decoding apparatus 103 includes demultiplexer 301, M signal decoding section 302, S signal decoding section 303, smoothing section 304, and L/R signal computation section 305.

Decoding apparatus 103 receives the encoded information transmitted from encoding apparatus 101 through transmission channel 102, decodes the encoded information based on the M/S decoding scheme, and computes the decoded L signal and the decoded R signal. Decoding apparatus 103 then outputs the computed decoded L and R signals as output signals of two channels. Hereinafter, each configuration will be described in detail.

Demultiplexer 301 separates the encoded information received from encoding apparatus 101 through transmission channel 102 into the M encoded information and the S encoded information, and outputs the separated M encoded information to M signal decoding section 302 and outputs the S encoded information to S signal decoding section 303, respectively. In addition, demultiplexer 301 detects whether there is a transmission error in the received encoded information. If a transmission error is detected, demultiplexer 301 detects a variation over time of the information included in the received encoded information. Demultiplexer 301 outputs the detected variation over time to smoothing section 304 as smoothing control information CI.

Here, how to determine smoothing control information CI in demultiplexer 301 will be described.

Demultiplexer 301 detects whether the S encoded information is included in the encoded information received from encoding apparatus 101 through transmission channel 102. Demultiplexer 301 detects the time at which the frame including the S encoded information is switched to the frame not including the S encoded information and the time at which the frame not including the S encoded information is switched to the frame including the S encoded information. If demultiplexer 301 detects the time at which the frame including the S encoded information is switched to the frame not including the S encoded information, the value of smoothing control information CI is set to 1. If demultiplexer 301 detects the time at which the frame not including the S encoded information is switched to the frame including the S encoded information, the value of smoothing control information CI is set to 2. If demultiplexer 301 detects neither the time at which the frame including the S encoded information is switched to the frame not including the S encoded information nor the time at which the frame not including the S encoded information is switched to the frame including the S encoded information, the value of smoothing control information CI is set to 0.

M signal decoding section 302 receives the M encoded information from demultiplexer 301, decodes the received M encoded information based on the CELP speech decoding scheme, and computes the decoded M signal. Here, the speech decoding method of M signal decoding section 302 corresponds to the encoding method of M signal encoding section 202 in encoding apparatus 101. M signal decoding section 302 outputs the computed decoded M signal to L/R signal computation section 305.

S signal decoding section 303 receives the S encoded information from demultiplexer 301, decodes the received S encoded information based on the CELP speech decoding scheme, and computes decoded S signal. Here, the speech decoding method of S signal decoding section 303 corresponds to the encoding method of S signal encoding section 203 in encoding apparatus 101. S signal decoding section 303 outputs the obtained decoded S signal to smoothing section 304. If the S encoded information is not received from demultiplexer 301, S signal decoding section 303 computes the decoded S signal by decoding the S encoded information included in the frame immediately prior to the current frame (for example, the frame prior to the current frame by one frame). S signal decoding section 303 stores the S encoded information or the decoded S signal of the current frame in the internal buffer and updates the internal buffer in each frame processing. Although, in the present embodiment, a description has been made for a method of concealing for the S signal using the aforementioned method as a concealment process in the event of frame loss such as when a transmission error occurs, the present embodiment is not limited thereto. The present embodiment may be similarly applied to other frame loss concealment processes. Since the CELP speech decoding scheme is already known in the art, detailed description thereof will not be repeated.

Smoothing section 304 receives the decoded S signal from S signal decoding section 303 and receives smoothing control information CI from demultiplexer 301. Smoothing section 304 performs an attenuation or amplification process on the time axis for the decoded S signal depending on the value of smoothing control information CI and computes the smoothed decoded S signal (hereinafter, referred to as "a smoothed decoded S signal"). Specifically, if the value of smoothing control information CI is 1, smoothing section 304 multiplies a slowly attenuating coefficient by the decoded S signal based on equation 3 and computes the smoothed decoded S signal. If the value of smoothing control information CI is 2, smoothing section 304 multiplies a slowly amplifying coefficient by the decoded S signal based on equation 4 and computes the smoothed decoded S signal. If the value of smoothing control information CI is 0, smoothing section 304 multiplies nothing by the decoded S signal, and the decoded S signal directly becomes the smoothed decoded S signal. Here, $\alpha 1_i$ of equation 3 is an attenuation coefficient of which the value decreases as i increases, and $\beta 1_i$ is an amplification coefficient of which the value increases as i increases.

(Equation 3)

$$S_i' = S_i \alpha 1_i (\text{if } CI=1, i=0, \ldots, N-1) \quad [3]$$

(Equation 4)

$$S_i' = S_i \beta 1_i (\text{if } CI=2, i=0, \ldots, N-1) \quad [4]$$

Smoothing section 304 outputs the computed smoothed decoded S signal to L/R signal computation section 305.

L/R signal computation section 305 receives the decoded M signal from M signal decoding section 302 and receives the smoothed decoded S signal from smoothing section 304. L/R signal computation section 305 computes the two-channel signal of the decoded L and R signals using the received decoded M signal and the received smoothed decode S signal based on equations 5 and 6 corresponding to M/S signal computation section 201 as follows.

(Equation 5)

$$L_i = M_i + S_i (i=0, \ldots, N-1) \quad [5]$$

(Equation 6)

$$R_i = M_i - S_i (i=0, \ldots, N-1) \quad [6]$$

L/R signal computation section 305 outputs the decoded L and R signals computed based on equations 5 and 6 as the output signals of two channels. Hereinbefore, a description of the configuration of decoding apparatus 103 has been made.

Figure 4:
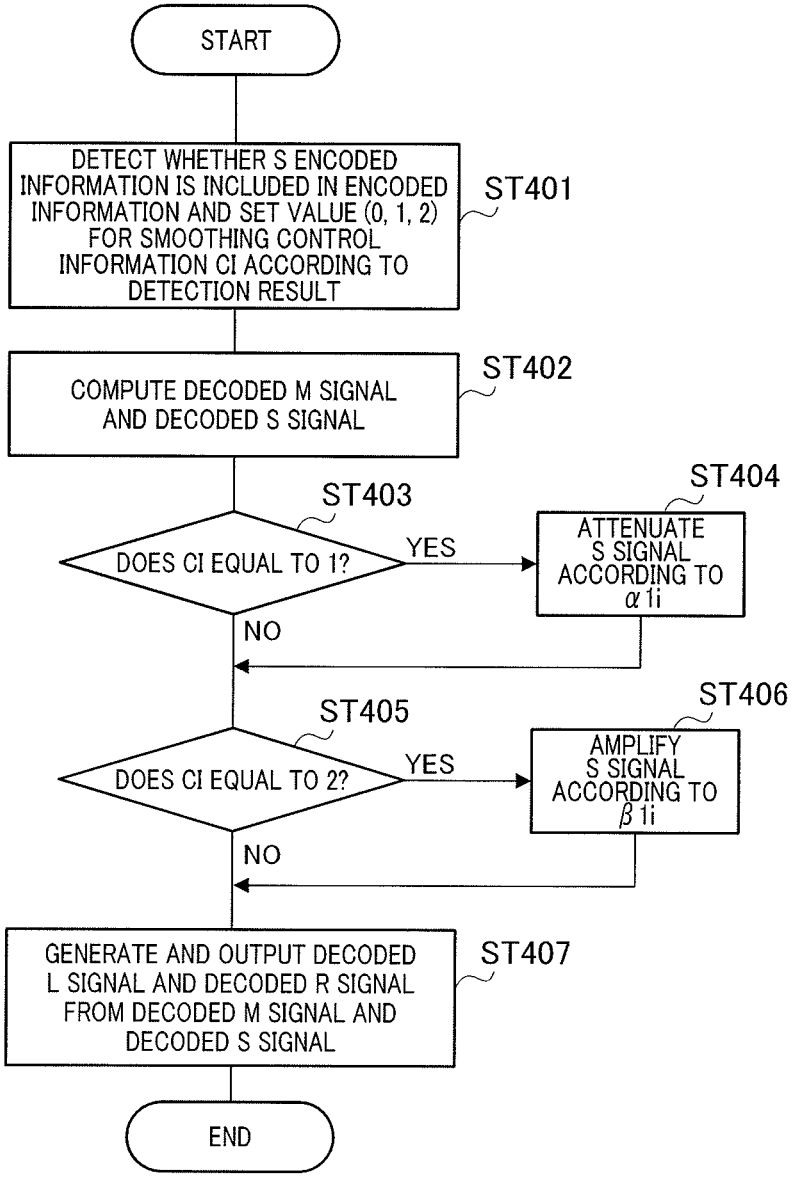
FIG. 4 is a flowchart illustrating the operations of the decoding apparatus according to Embodiment 1 of the present invention.

Next, the operation of decoding apparatus 103 will be described with reference to FIG. 4. FIG. 4 is a flowchart illustrating the operations of the decoding apparatus 103.

First, demultiplexer 301 detects whether the S encoded information is included in the encoded information and sets the values (0, 1, or 2) for smoothing control information CI according to the detection result (step ST 401).

Then, M signal decoding section 302 computes the decoded M signal from the M encoded information, and S signal decoding section 303 computes the decoded S signal from the S encoded information (step ST 402).

Then, smoothing section 304 determines whether the value of smoothing control information CI is 1 (step ST 403).

If the value of smoothing control information CI is 1 (YES in step ST 403), smoothing section 304 multiplies the decoded S signal by the coefficient $\alpha 1_i$ to be slowly attenuated to compute the smoothed decoded S signal (step ST 404).

Meanwhile, if the value of smoothing control information CI is not 1 (NO in step ST 403), smoothing section 304 determines whether the value of smoothing control information CI is 2 (step ST 405).

If the value of smoothing control information CI is 2 (YES in step ST 405), the decoded S signal is multiplied by the coefficient $\beta 1_i$ to be slowly amplified to compute the smoothed decoded S signal (step ST 406).

If the value of smoothing control information CI is not 2 (NO in step ST 405), that is, if the value of smoothing control information CI is 0, the decoded S signal is multiplied by nothing and is directly set as the smoothed decoded S signal.

L/R signal computation section 305 computes the decoded L and R signals from the computed decoded M and S signals and outputs the computed decoded L and R signals (step ST 407).

Likewise, according to the present embodiment, for example, in the multi-channel signal encoding/decoding scheme such as the M/S encoding/decoding scheme, when a transmission error occurs owing to frame loss or the like, smoothing the number of channels between frames is performed not at a parameter level but at a signal level. As a result, it is possible to alleviate an abrupt change in the number of channels of the decoded signals and suppress sound quality deterioration. According to the present embodiment, it is possible to smooth the decoded signals in the unit of sample by smoothing the number of channels at the signal level and further suppress sound quality deterioration.

In the present embodiment, while a description has been made for the operation of decoding apparatus 103 with reference to the flowchart of FIG. 4, the present invention is not limited to such a flow. For example, the order of steps ST 403 to ST 404 may be reversible to the order of steps ST 405 to ST 406. In the present embodiment, while a description has been made for the M/S encoding/decoding scheme as an example of the multi-channel encoding/decoding methods, the present invention is not limited thereto and may be similarly applied to other multi-channel encoding/decoding methods.

In the present embodiment, while a description has been exemplarily made for a configuration in which the attenuation coefficient and the amplification coefficient change from 1 to 0 or from 0 to 1 while a single frame is processed, the present invention is not limited thereto and may be similarly applied to a case where change in the attenuation coefficient and the amplification coefficient is further delayed. Specifically, the attenuation coefficient and the amplification coefficient may slowly change from 1 to 0 or from 0 to 1 while the decoding apparatus processes the encoded information of several frames. In this case, the decoding apparatus memorizes the frame at which the attenuation process or the amplification process for the S signal is initiated and slowly changes the attenuation coefficient and the amplification coefficient when there is a predetermined number of frames which are to be processed from that frame. In this configuration, when a transmission error occurs owing to the frame loss, it is possible to further alleviate an abrupt change in the number of channels in the decoded signal and further suppress sound quality deterioration in comparison to the configuration of the present embodiment.

For the decoded S signal to be smoothed described in the present embodiment, the present invention may be similarly applied to the decoded S signal concealed using methods other than the aforementioned concealment process at the time of the transmission error. For example, the present invention may be similarly applied to a configuration in which the attenuation process or the amplification process described in the present embodiment is performed for the decoded S signal. The decoded S signal is temporally attenuated or amplified by using the parameter for decoding the S signal or by using the decoded S signal of the frame immediately before the transmission error occurs.

Embodiment 2

Figure 5:
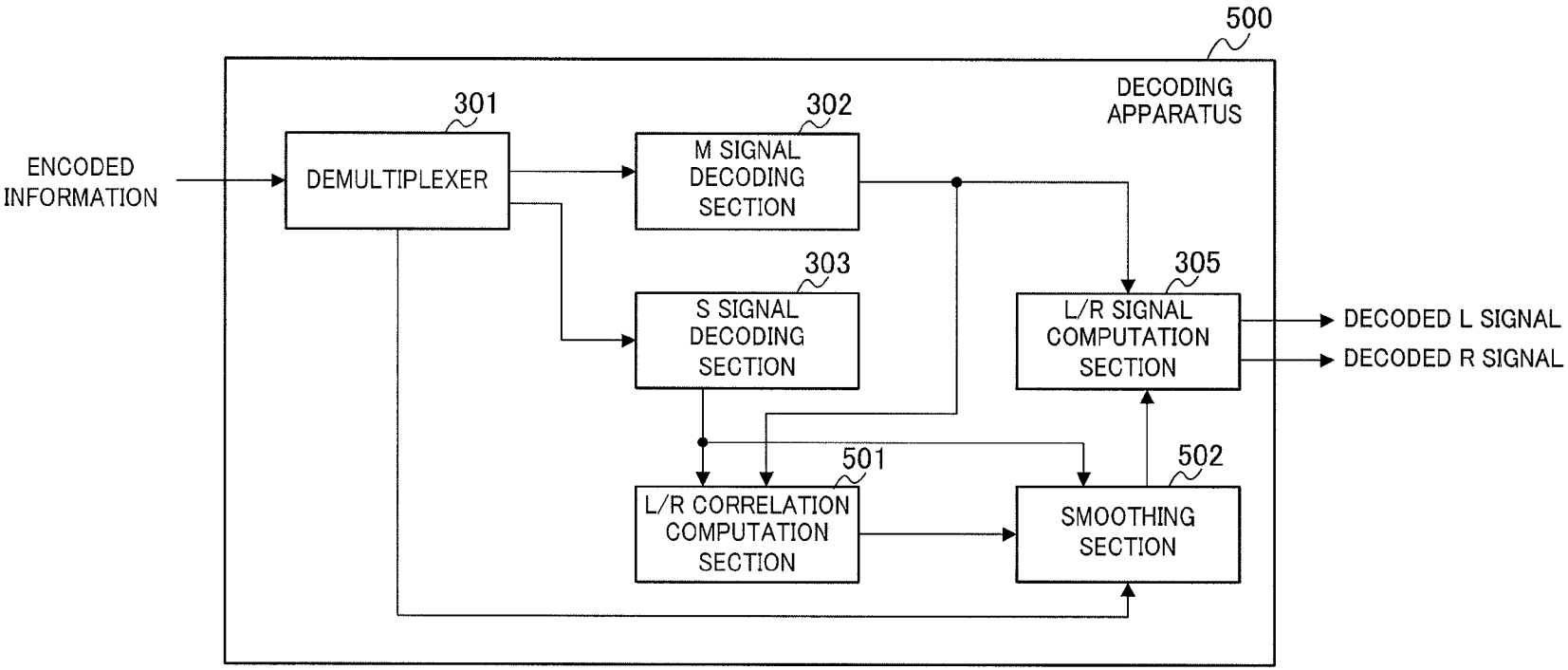
FIG. 5 is a block diagram illustrating a configuration of the decoding apparatus according to Embodiment 2 of the present invention.

FIG. 5 is a block diagram illustrating a configuration of decoding apparatus 500 according to Embodiment 2 of the present invention.

In decoding apparatus 500 illustrated in FIG. 5, L/R correlation computation section 501 is added to decoding apparatus 103 of FIG. 3 according to Embodiment 1, and smoothing section 304 is substituted with smoothing section 502. In FIG. 5, like reference numerals denote like elements as in FIG. 3, and description thereof will not be repeated. Since the communication system according to the present embodiment is similar to that illustrated in FIG. 1 except that decoding apparatus 103 is substituted with decoding apparatus 500, a description thereof will not be repeated. While demultiplexer 301 computes smoothing control information CI in Embodiment 1, it computes first smoothing control information CI1 according to the present embodiment.

Decoding apparatus 500 includes demultiplexer 301, M signal decoding section 302, S signal decoding section 303, L/R correlation computation section 501, smoothing section 502, and L/R signal computation section 305. Hereinafter, each configuration will be described in detail.

M signal decoding section 302 receives the M encoded information from demultiplexer 301 and decodes the received M encoded information based on the CELP speech decoding scheme to compute the decoded M signal. Here, the speech decoding method of M signal decoding section 302 corresponds to the encoding method of M signal encoding section 202 in encoding apparatus 101. In addition, M signal decoding section 302 outputs the computed decoded M signal to L/R signal computation section 305 and L/R correlation computation section 501.

S signal decoding section 303 receives the S encoded information from demultiplexer 301 and decodes the received S encoded information based on the CELP speech decoding scheme to compute the decoded S signal. Here, the speech decoding method of S signal decoding section 303 corresponds to the encoding method of S signal encoding section 203 in encoding apparatus 101. In addition, S signal decoding section 303 outputs the obtained decoded S signal to L/R correlation computation section 501 and smoothing section 502. When the S encoded information is not received from demultiplexer 301, S signal decoding section 303 computes the decoded S signal by decoding the S encoded information included in the frame immediately prior to the current frame. S signal decoding section 303 memorizes the S encoded information or the decoded S signal of the current frame in the internal buffer and updates the internal buffer while processing each frame.

L/R correlation computation section 501 receives the decoded M signal from M signal decoding section 302 and receives the decoded S signal from S signal decoding section 303. In addition, L/R correlation computation section 501 computes the energy ratio between the L channel and the R channel from the decoded M signal and the decoded S signal as the correlation between the L channel and the R channel to determine second smoothing control information CI2 depending on the computed energy ratio. Second smoothing control information CI2 is computed based on equation 7. Specifically, if the energy ratio between the L channel and the R channel is equal to or greater than first threshold TH1 or equal to or less than the second threshold TH2 (where TH2<TH1), L/R correlation computation section 501 sets the value of second smoothing control information CI2 to 1. In addition, if the energy ratio between the L channel and the R channel is between the first threshold and the second threshold, L/R correlation computation section 501 sets the value of second smoothing control information CI2 to 0. Here, TH1 and TH2 of equation 7 are threshold values determined in advance. That is, the value of second smoothing control information CI2 is set to 1 in a case where the energy ratio between the L channel and the R channel differs significantly, and the value of second smoothing control information CI2 is set to 0 in a case where the energy ratio is not significantly different.

(Equation 7)

$$CI2 = \begin{cases} 1 & \left( \text{if} \left( \begin{array}{l} \sum_{i=0}^{N-1} \left| \frac{M_i + S_i}{M_i - S_i} \right| \geq TH1 \text{ or} \\ \sum_{i=0}^{N-1} \left| \frac{M_i + S_i}{M_i - S_i} \right| \leq TH2 \end{array} \right) \right) (i = 0, \ldots, N-1) \\ 0 & \text{(else)} \end{cases} \quad [7]$$

L/R correlation computation section 501 outputs obtained second smoothing control information CI2 to smoothing section 502.

Smoothing section 502 receives the decoded S signal from S signal decoding section 303 and receives first smoothing control information CI1 from demultiplexer 301. In addition, smoothing section 502 receives second smoothing control information CI2 from L/R correlation computation section 501. Smoothing section 502 performs an attenuation or amplification process along the time axis for the decoded S signal according to the values of first smoothing control information CI1 and second smoothing control information CI2 in order to compute the smoothed decoded S signal. Specifically, if the value of second smoothing control information CI2 is set to 1, smoothing section 502 smoothes the decoded S signal based on equations 8 and 9. Here, $\alpha 2_i$ of equation 8 is the attenuation coefficient which decreases as i increases, and $\beta 2_i$ of equation 9 is the amplification coefficient which increases as i increases. $\alpha 2_i$ and $\beta 2_i$ vary (change amount) less than $\alpha 1_i$ and $\beta 1_i$ as i increases.

(Equation 8)

$$S_i' = S_i \cdot \alpha 2_i (\text{if } CI=1, i=0, \ldots, N-1) \quad [8]$$

(Equation 9)

$$S_i' = S_i \cdot \beta 2_i (\text{if } CI=2, i=0, \ldots, N-1) \quad [9]$$

If the value of second smoothing control information CI2 is 0, smoothing section 502 smoothes the decoded S signal based on equations 3 and 4 as described above. Smoothing section 502 outputs the computed smoothed decoded S signal to L/R signal computation section 305.

L/R signal computation section 305 receives the decoded M signal from M signal decoding section 302 and receives the smoothed decoded S signal from smoothing section 502. L/R signal computation section 305 computes the two-channel signal of the decoded L and R signals based on equations 5 and 6 corresponding to M/S signal computation section 201. L/R signal computation section 305 outputs the computed decoded L and R signals as the output signals of the two channels. Hereinbefore, a description of the configuration of decoding apparatus 500 has been made.

Figure 6:
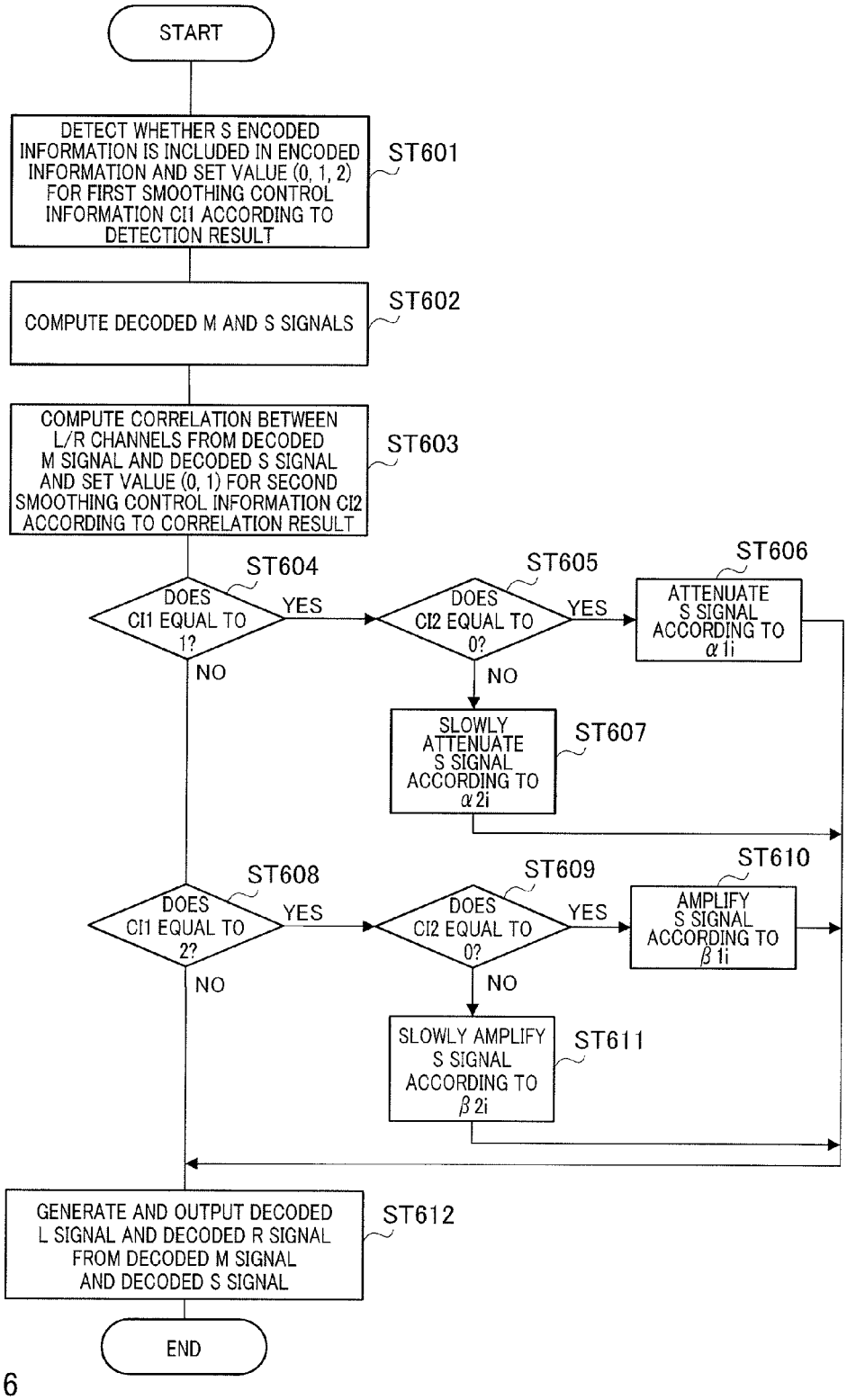
FIG. 6 is a flowchart illustrating a configuration of the decoding apparatus according to Embodiment 2 of the present invention.

Next, the operation of decoding apparatus 500 will be described with reference to FIG. 6. FIG. 6 is a flowchart illustrating the operations of decoding apparatus 500.

First, demultiplexer 301 detects whether the S encoded information is included in the encoded information and sets the value (0, 1, or 2) for first smoothing control information CI1 according to the detection result (step ST 601).

Then, M signal decoding section 302 computes the decoded M signal from the M encoded information, and S signal decoding section 303 computes the decoded S signal from the S encoded information (step ST 602).

Then, L/R correlation computation section 501 sets the value (0 or 1) for second smoothing control information CI2 according to the energy ratio between the L channel and the R channel (step ST 603).

Then, smoothing section 502 determines whether the value of first smoothing control information CI1 is 1 (step ST 604).

If the value of first smoothing control information CI1 is 1 (YES in step ST 604), smoothing section 502 determines whether the value of second smoothing control information CI2 is 0 (step ST 605).

If the value of second smoothing control information CI2 is 0 (YES in step ST 605), smoothing section 502 multiplies the decoded S signal by the coefficient $\alpha 1_i$ to be slowly attenuated in order to compute the smoothed decoded S signal (step ST 606).

If the value of second smoothing control information CI2 is not 0 (NO in step ST 605), that is, if the value of second smoothing control information CI2 is 1, smoothing section 502 multiplies the decoded S signal by the coefficient $\alpha 2_i$ to be slowly attenuated to an amount less than that of step ST 606 in order to obtain the smoothed decoded S signal (step ST 607).

Meanwhile, if the value of first smoothing control information CI1 is not 1 in step ST 604 (NO in step ST 604), smoothing section 502 determines whether the value of first smoothing control information CI1 is 2 (step ST 608).

If the value of first smoothing control information CI1 is 2 (YES in step ST 608), smoothing section 502 determines whether the value of second smoothing control information CI2 is 0 (step ST 609).

If the value of second smoothing control information CI2 is 0 (YES in step ST 609), smoothing section 502 multiplies the decoded S signal by the coefficient $\beta 1_i$ to be slowly amplified to compute the smoothed decoded S signal (step ST 610).

In addition, if the value of second smoothing control information CI2 is not 0 (NO in step ST 609), that is, if the value of second smoothing control information CI2 is 1, smoothing section 502 multiplies the decoded S signal by the coefficient $\beta 2_i$ to be slowly amplified to an amount less than that of step ST 610 in order to compute the smoothed decoded S signal (step ST 611).

In step ST 608, if the value of first smoothing control information CI1 is not 2 (NO in step ST 608), that is, if the value of first smoothing control information CI1 is 0, smoothing section 502 multiplies the decoded S signal by nothing and directly uses it as the smoothed decoded S signal.

L/R signal computation section 305 computes the decoded L and R signals from the computed decoded M signal and smoothed decoded S signal and outputs the computed decoded L and R signals (step ST 612).

Likewise, according to the present embodiment, in addition to the effect of Embodiment 1, for example, in a multichannel signal encoding/decoding scheme such as the M/S encoding/decoding scheme, it is possible to suppress sound quality deterioration when a transmission error occurs owing to frame loss and the like. That is, according to the present embodiment, when smoothing the number of channels between frames not at the parameter level but at the signal level, a smoothing velocity is adjusted using the energy ratio as the correlation between the L channel and the R channel. As a result, it is possible to suppress the sound quality deterioration. Specifically, when the signal is concentrated on one channel out of two-channel signal, the change rate of the number of channels is further reduced by delaying the smoothing as the attenuation process or the amplification process (by reducing the time change amount). This is because there is a tendency that an abrupt change of the stereo image (stereo sense) may adversely affect the sense of hearing when the signal is concentrated on one channel out of the two-channel signal. Through the process described above, it is possible to further suppress the sound quality deterioration in the configuration shown in Embodiment 1.

Although a description of the present embodiment has been made for the operation of decoding apparatus 500 with reference to the flowchart of FIG. 6, the present invention is not limited to such a flow. For example, the order of steps ST 604 to ST 607 may be reversible to the order of steps ST 608 to ST 611. Although description has been exemplarily made in the present embodiment for a case where L/R correlation computation section 501 computes the correlation between the L/R channels based on the decoded M and S signals, the present invention is not limited thereto. The present invention may be similarly applied to a case where the correlation between the M/S channels is used.

In the present embodiment, a description has been made for a configuration in which whether the energy ratio between the L channel and the R channel is equal to or greater than a predetermined first threshold or equal to or less than a second threshold is used as a determination criterion as to the determination of the value of the second smoothing control information, and the second smoothing control information is set to 0 or 1 as a binary value depending on the determination result. However, the present embodiment is not limited thereto and may be similarly applied to a configuration in which the second smoothing control information is set not as a binary value but as a weight. That is, for example, as the difference of energy between the L channel and the R channel increases, the value of the second smoothing control information may be approximated to 1. The value of the second smoothing control information may be approximated to 0 as the energy difference between the L channel and R channel decreases. In the smoothing section, smoothing can be performed more precisely by slowly attenuating or amplifying the decoded S signal as the value of the second smoothing control information is approximated to 1. As a result, it is possible to further suppress sound quality deterioration.

Embodiment 3

Figure 7:
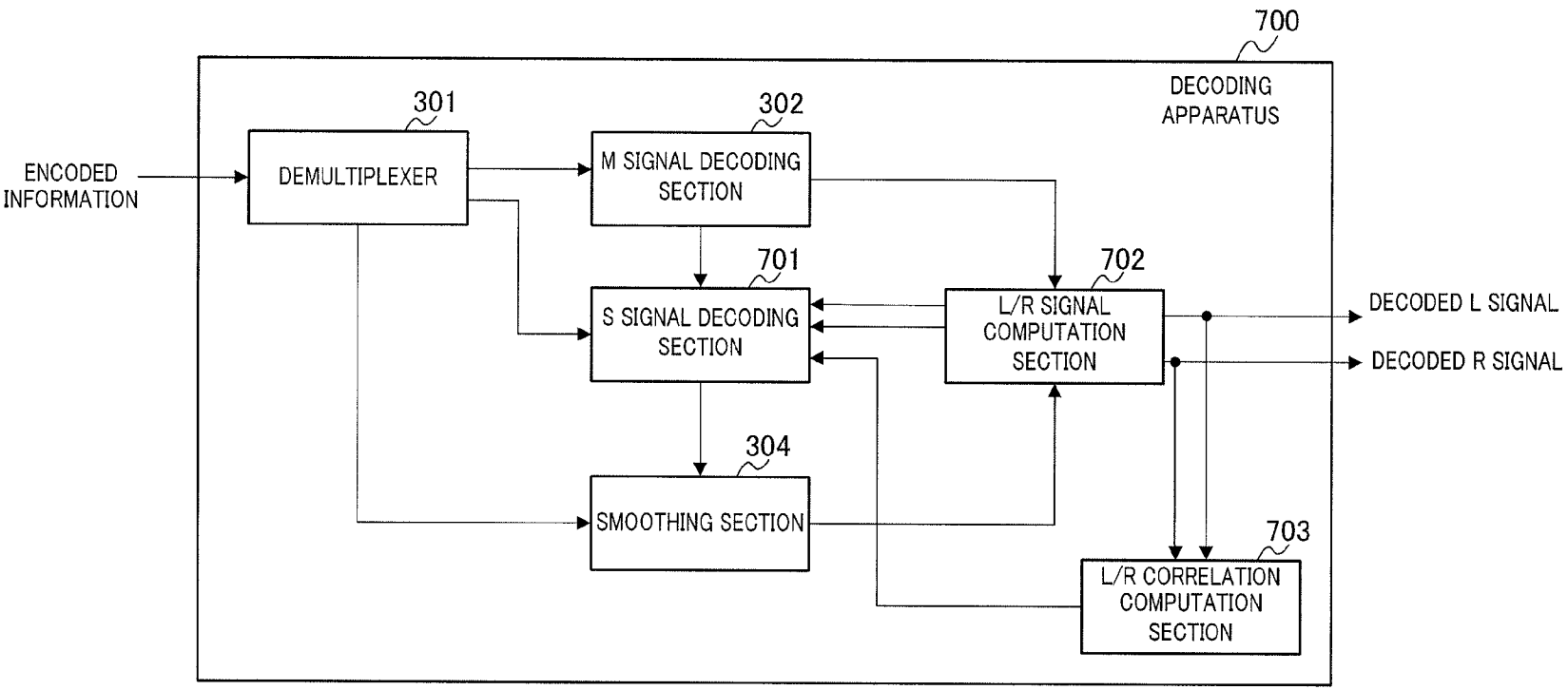
FIG. 7 is a block diagram illustrating a configuration of the decoding apparatus according to Embodiment 3 of the present invention.

FIG. 7 is a block diagram illustrating a configuration of decoding apparatus 700 according to Embodiment 3 of the present invention.

In decoding apparatus 700 illustrated in FIG. 7, L/R correlation computation section 703 is added to decoding apparatus 103 of Embodiment 1 of FIG. 3, S signal decoding section 701 is substituted with S signal decoding section 303, and L/R signal computation section 702 is substituted with L/R signal computation section 305. In FIG. 7, like reference numerals denote like elements as in FIG. 3, and a description thereof will not be repeated. The communication system according to the present embodiment has a configuration similar to that of FIG. 1 except that decoding apparatus 103 is substituted with decoding apparatus 700. Therefore, a description thereof will not be repeated.

Decoding apparatus 700 includes demultiplexer 301, M signal decoding section 302, S signal decoding section 701, smoothing section 304, L/R signal computation section 702, and L/R correlation computation section 703. Hereinafter, each configuration will be described in detail.

Demultiplexer 301 separates the encoded information received from encoding apparatus 101 through transmission channel 102 into the M encoded information and the S encoded information, outputs the separated M encoded information to M signal decoding section 302, and outputs the separated S encoded information to S signal decoding section 701. Demultiplexer 301 detects whether a transmission error exists in the received encoded information. Demultiplexer 301 detects the variation over time of the information included in the received encoded information in a case where a transmission error is detected, and outputs the detected variation over time to smoothing section 304 as smoothing control information CI.

M signal decoding section 302 receives the M encoded information from demultiplexer 301 and decodes the received M encoded information based on the CELP speech decoding scheme to compute the decoded M signal. Here, the speech decoding method of M signal decoding section 302 corresponds to the encoding method of M signal encoding section 202 in encoding apparatus 101. In addition, M signal decoding section 302 outputs the computed decoded M signal to S signal decoding section 701 and L/R signal computation section 702.

S signal decoding section 701 receives the S encoded information from demultiplexer 301, decodes the received S encoded information in the CELP speech decoding scheme, and computes the decoded S signal. Here, the speech decoding method of S signal decoding section 701 corresponds to the encoding method of S signal encoding section 203 in encoding apparatus 101. S signal decoding section 701 outputs the computed decoded S signal to smoothing section 304.

If the encoded information is not received from demultiplexer 301, S signal decoding section 701 computes the decoded S signal using the method described below. That is, S signal decoding section 701 computes the decoded S signal based on equation 10 using ancillary information AI of the decoded S signal in the frame prior to the current frame by one frame (hereinafter, referred to as the previous frame), received from L/R correlation computation section 703, the decoded M signal received from M signal decoding section 302, and the decoded L signal and the decoded R signal from the previous frame received from L/R signal computation section 702. $L'^{-1}$ and $R'^{-1}$ of equation 10 are the signals computed from the decoded L signal from the previous frame or the decoded R signal from the previous frame. In addition, ancillary information AI of the decoded S signal will be described below.

(Equation 10)

$$S_i = \begin{cases} L_i'^{-1} - M_i & (\text{if } AI = 0, \quad i = 0, \ldots, N-1) \\ M_i - R_i'^{-1} & (\text{if } AI = 1, \quad i = 0, \ldots, N-1) \end{cases} \quad [10]$$

Here, a method of computing $L'^{-1}$ and $R'^{-1}$ in the S signal decoding section 701 will be described. $L'^{-1}$ and $R'^{-1}$ are computed using the decoded L signal and the decoded R signal from the previous frame and the pitch period obtained from the M encoded information when the decoded M signal is computed in M signal decoding section 302 for the decoded L signal ($L^{-1}$) and the decoded R signal ($R^{-1}$) from the previous frame. Specifically, S signal decoding section 701 cuts out the waveform of a single pitch period of the decoded L signal or the decoded R signal in the previous frame and computes $L'^{-1}$ and $R'^{-1}$ by sliding several samples along the time axis to match the peaks and valleys of the waveform of the decoded M signal. That is, S signal decoding section 701 slides the decoded L signal or the decoded R signal from the previous frame along the time axis so that the phase matches between the M signal of the current frame and the decoded L signal or the decoded R signal of the previous frame. Peaks and valleys may be matched between the signals obtained by repeating the waveform corresponding to a single pitch period of the decoded L or R signal from the previous frame and the decoded M signal of the current frame. In this case, it is possible to generate a waveform of the frame length without any problem even by sliding several samples.

Figure 8:
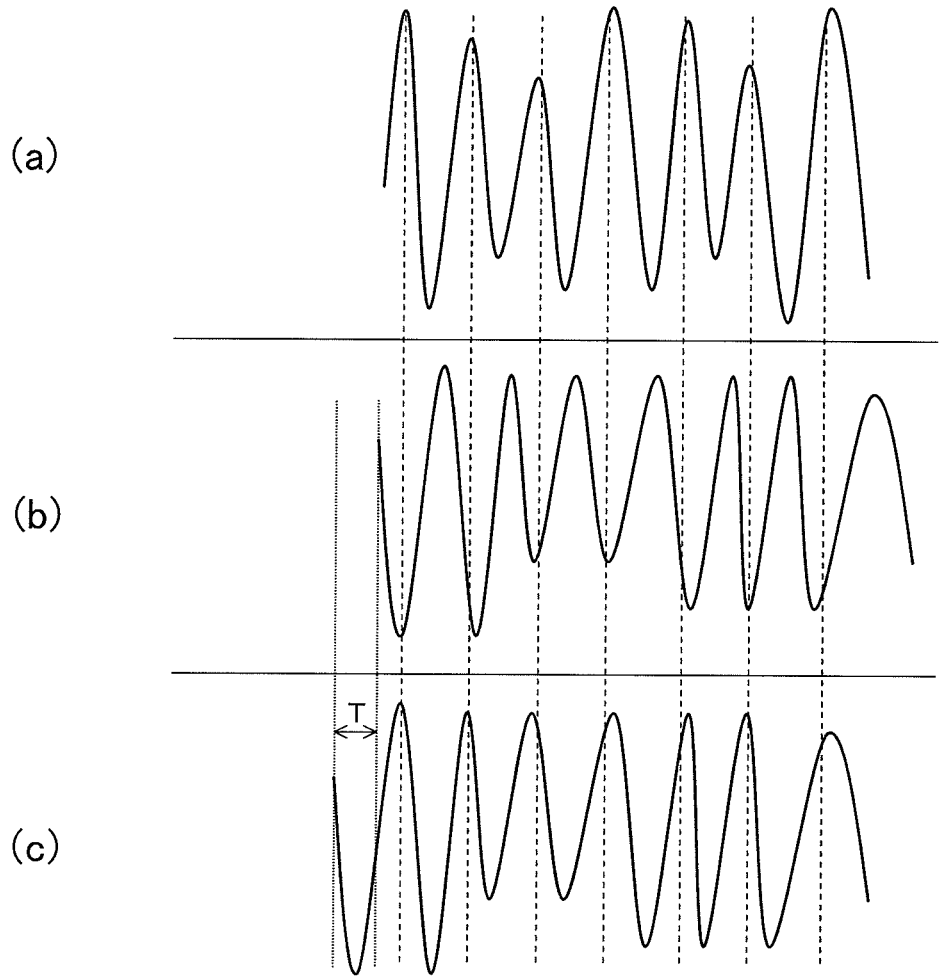
FIG. 8 is a diagram illustrating a process of matching peaks and valleys of the waveform in the S signal decoding section according to Embodiment 3 of the present invention.

Here, a process for matching peaks and valleys of the waveforms described above will be described with reference to FIG. 8. FIG. 8 is a diagram illustrating the process for matching the peaks and valleys of the waveform according to S signal decoding section 701. FIG. 8(*a*) illustrates the waveform of the decoded M signal of the current frame, FIG. 8(*b*) illustrates the decoded L signal ($L'^{-1}$) from the previous frame, and FIG. 8(*c*) illustrates the decoded L signal ($L'^{-1}$) from the previous frame obtained by summing the pitch period and the decoded M signal. Here, a case where the energy of the decoded L signal from the previous frame is greater than the energy of the decoded R signal from the previous frame will be used as an example.

Here, since the frame is different between the decoded L signal from the previous frame and the decoded M signal of the current frame, the pitch period may not match at the signal waveform level. In this case, the effective decoded S signal is not obtained by simply performing a subtraction as in equation 10. Therefore, a process of matching the waveform and the pitch period of the decoded M signal in FIG. 8(*a*) by deviating from the waveform of the decoded L signal from the previous frame of FIG. 8(*b*) with several samples (T in FIG. 8(*c*)). As a result, it is possible to generate the waveform of the decoded L signal of the previous frame as illustrated in FIG. 8(*c*). It is possible to compute the decoded S signal with high precision based on equation 10 by using the waveform of FIG. 8(*c*) and the waveform of FIG. 8(*a*).

Smoothing section 304 receives the decoded S signal from S signal decoding section 701 and smoothing control information CI from demultiplexer 301. Smoothing section 304 performs the attenuation process or the amplification process along the time axis for the decoded S signal depending on the value of smoothing control information CI to compute the smoothed decoded S signal. Specifically, if the value of smoothing control information CI is 1, smoothing section 304 computes the smoothed decoded S signal based on equation 3 by multiplying the decoded S signal by a coefficient to be slowly attenuated. If the value of smoothing control information CI is 2, smoothing section 304 multiplies the decoded S signal by a coefficient to be slowly amplified based on equation 4 to compute the smoothed decoded S signal. If the value of smoothing control information CI is 0, smoothing section 304 multiplies the decoded S signal by nothing and sets the decoded S signal as the smoothed decoded S signal. Smoothing section 304 outputs the computed smoothed decoded S signal to L/R signal computation section 702.

L/R signal computation section 702 receives the decoded M signal from M signal decoding section 302 and the smoothed decoded S signal from smoothing section 304. L/R signal computation section 702 computes the two-channel signals of the decoded L and R signals based on equations 5 and 6 corresponding to M/S signal computation section 201. L/R signal computation section 702 outputs the computed decoded L and R signals as output signals of the two channels. L/R signal computation section 702 outputs the computed decoded L signal and the computed decoded R signal to S signal decoding section 701 and L/R correlation computation section 703.

L/R correlation computation section 703 receives the decoded L signal and the decoded R signal from L/R signal computation section 702. L/R correlation computation section 703 computes the energy ratio as the correlation between the L channel and the R channel from the received decoded L and R signals and determines ancillary information AI of the decoded S signal depending on the energy ratio. Here, ancillary information AI of the decoded S signal is computed based on equation 11. Specifically, L/R correlation computation section 703 compares the L signal and the R signal. If the energy of the L signal is greater than the energy of the R signal, the value of ancillary information AI of the decoded S signal is set to 0. If the energy of the R signal is equal to greater than the energy of the L signal, the value of ancillary information AI of the decoded S signal is set to 1.

(Equation 11)

$$AI = \begin{cases} 0 & \left(\text{if}\left(\sum_{i=0}^{N-1} L_i^2 \geq \sum_{i=0}^{N-1} R_i^2\right)\right) \\ 1 & (\text{else}) \end{cases} \quad [11]$$

L/R correlation computation section 703 outputs the ancillary information of the obtained decoded S signal to S signal decoding section 701. Hereinbefore, a description of the configuration of decoding apparatus 700 has been made.

Figure 9:
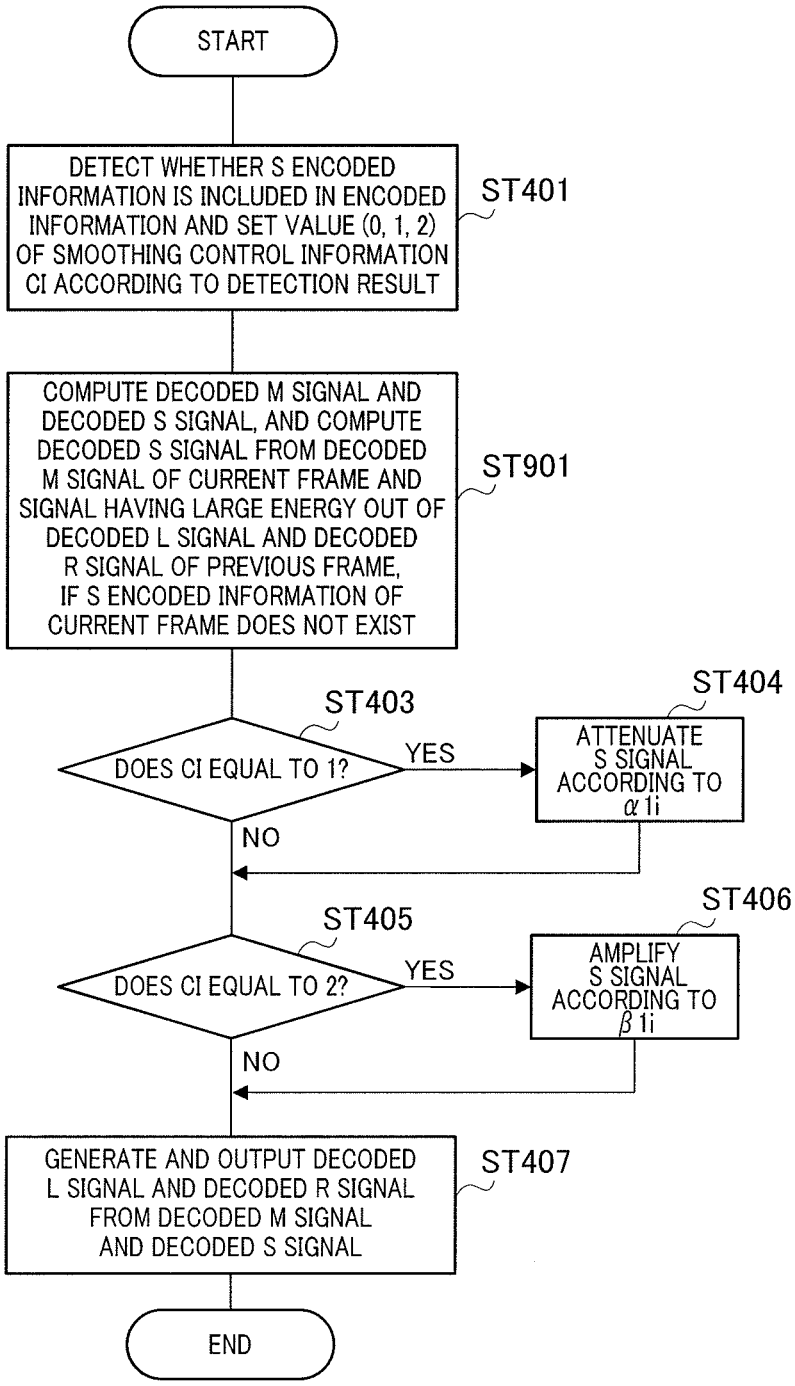
FIG. 9 is a flow chart illustrating the operations of the decoding apparatus according to Embodiment 3 of the present invention.

Next, operations of decoding apparatus 700 will be described with reference to FIG. 9. FIG. 9 is a flowchart illustrating the operations of decoding apparatus 700. In FIG. 9, like reference numerals denote like elements as in FIG. 4, and a description thereof will not be repeated.

Demultiplexer 301 detects whether the S encoded information is included in the encoded information and sets the value (0, 1, or 2) for smoothing control information CI depending on the detection result (step ST 401).

Then, M signal decoding section 302 computes the decoded M signal, and S signal decoding section 701 computes the decoded S signal. Here, if the S encoded information is not include in the encoded information, S signal decoding section 701 computes the decoded S signal using ancillary information AI of the decoded S signal from the previous frame received from L/R correlation computation section 703, the decoded M signal received from M signal decoding section 302, and the decoded L signal and the decoded R signal of the previous frame received from L/R signal computation section 702 (step ST 901).

Then, smoothing section 304 determines whether the value of smoothing control information CI is 1(step ST 403).

In this manner, according to the present embodiment, in addition to the effects of Embodiment 1, in the multi-channel signal encoding/decoding scheme such as the M/S encoding/decoding scheme, it is possible to suppress sound quality deterioration when a transmission error occurs owing to frame loss and the like. That is, according to the present embodiment, when smoothing the number of channels between frames not at the parameter level but at the signal level, the decoded S signal of the lost frame is computed using the energy ratio between the decoded L signal and the decoded R signal decoded in the previous frame. As a result, it is possible to suppress sound quality deterioration. Specifically, in a case where the signals are concentrated on any one of two channels in the previous frame, it is possible to compute the decoded S signal with high precision from the M signal received and normally decoded, and the decoded signal (decoded signal of the previous frame) from the channel where the signals are concentrated. The aforementioned method is particularly effective when the channels where the signals concentrated across the frame are not frequently switched.

Although the two-channel signal includes the L signal and the R signal according to Embodiments 1 to 3, the present invention is not limited thereto. The L signal and the R signal described above may be set oppositely. Even in this case, similar functions and effects can be obtained.

In Embodiments 1 to 3, a description has been made so that the decoding scheme of decoding apparatuses 103, 500, and 700 corresponds to the encoding scheme of encoding apparatus 101. However, the present invention is not limited thereto and may be embodied such that the decoding apparatus decodes the encoded information generated by the encoding apparatus capable of generating decodable encoded information. The energy ratio is used as the correlation between the L channel and the R channel in Embodiments 1 to 3 described above, but the present invention is not limited thereto. Other indices may be used instead.

In addition, the present invention may be embodied in a case where the signal processing program according to Embodiments 1 to 3 described above is recorded or written on/to a machine-readable recording media such as memories, discs, tapes, compact discs (CDs), or digital versatile discs (DVDs), and the operation is performed. In this case, it is possible to also obtain the same functions and effects as those of each embodiment.

Although Embodiments 1 to 3 have been described in terms of hardware, the present invention may be embodied in terms of software.

In Embodiments 1 to 3, each function block is typically implemented as a large scale integrated (LSI) circuit. Each of them may be integrated in each individual chip, or a part or all of them may be integrated into a single chip. In this case, the LSI may be called an integrated circuit (IC), a system LSI, a super LSI, or an ultra LSI depending on an integration density.

In Embodiments 1 to 3 described above, the technique of integrating circuits is not limited to the LSI, and may be embodied in a dedicated circuit or a general purpose processor. A field programmable gate array (FPGA) that can be programmed after the manufacture of LSI or a reconfigurable processor capable of repeatedly configuring connections or settings of a circuit cell inside the LSI may be used.

In Embodiments 1 to 3 described above, when advances in a semiconductor technology or derivative technologies result in an IC technology substitutable with the LSI, functional blocks may be integrated using such a technology. The present invention may be applicable to a bio-technology.

The disclosure of Japanese Patent Application No. 2009-126615, filed on May 26, 2009, including the specification, drawings and abstract, is incorporated herein by reference in its entirety.

INDUSTRIAL APPLICABILITY

In the decoding apparatus and the decoding method according to the present invention, it is possible to suppress sound quality deterioration even when a transmission error occurs owing to frame loss. The present invention may be applicable to, for example, a packet communication system, a mobile communication system, and the like.

The invention claimed is:

1. A decoding apparatus, comprising:

a receiver that receives an encoded monaural signal obtained by encoding a monaural signal computed from first and second channel signals of a stereo signal and an encoded difference signal obtained by encoding a difference signal between the first and second channel signals;

a detector that detects a variation over time of the received encoded difference signal;

a decoder that decodes the received encoded monaural signal to obtain the decoded monaural signal and decodes the received encoded difference signal to obtain the decoded difference signal;

a smoothing section, including a processor, that smoothes the decoded difference signal by an operation of the decoded difference signal and a coefficient corresponding to the detected variation over time; and a computation section, including a processor, that computes the decoded stereo signal from the decoded monaural signal and the decoded difference signal obtained by smoothing, wherein the detector detects, as the variation over time, that a frame including the encoded difference signal is changed to a frame not including the encoded difference signal or that a frame not including the encoded different signal is changed to a frame including the encoded difference signal.

2. The decoding apparatus according to claim 1, further comprising a correlation computation section, including a processor, that computes a correlation between the first channel signal and the second channel signal from the decoded monaural signal and the decoded difference signal, wherein the smoothing section multiplies the decoded difference signal by the coefficient that differs depending on the correlation.

3. The decoding apparatus according to claim 2, wherein the correlation computation section computes an energy ratio between the first channel signal and the second channel signal as the correlation, and the smoothing section multiplies the decoded difference signal by the coefficient that differs depending on the energy ratio.

4. The decoding apparatus according to claim 3, wherein the smoothing section multiplies the decoded difference signal by the coefficient, the coefficient being set such that an amplification amount or an attenuation amount of the decoded difference signal is reduced in a case where the energy ratio is equal to or greater than a first threshold or equal to or less than a second threshold smaller than the first threshold in comparison with a case where the energy ratio is less than the first threshold and greater than the second threshold.

5. A base station comprising the decoding apparatus according to claim 1.

6. The decoding apparatus according to claim 1, further comprising a correlation computation section, including a processor, that computes a correlation between a decoded first channel signal which is a decoding result of the first channel signal and a decoded second channel signal which is a decoding result of the second channel signal, included in the decoded stereo signal, wherein, if the encoded difference signal is not included in the current frame, the decoder obtains the decoded monaural signal of the current frame and the decoded difference signal of the current frame from the decoded first channel signal or the decoded second channel signal of the frame prior to the current frame based on the computed correlation.

7. The decoding apparatus according to claim 6, wherein:

the correlation computation section computes an energy ratio between the decoded first channel signal and the decoded second channel signal as the correlation, and the decoder obtains the decoded difference signal of the current frame based on the energy ratio.

8. The decoding apparatus according to 7, wherein the decoder obtains the decoded difference signal of the current frame from any one of the decoded first channel signal and the decoded second channel signal of the previous frame having a large energy ratio computed by the correlation computation section and the decoded monaural signal of the current frame.

9. A communication terminal apparatus comprising the decoding apparatus according to claim 1.

10. A decoding method, comprising:

receiving, using a receiver, an encoded monaural signal obtained by encoding a monaural signal computed from first and second channel signals of a stereo signal and an encoded difference signal obtained by encoding a difference signal between the first and second channel signals;

detecting, using a detector, a variation over time of the received encoded difference signal;

decoding, using a decoder, the received encoded monaural signal to obtain the decoded monaural signal and decoding the received encoded difference signal to obtain the decoded difference signal;

smoothing, using a smoothing section including a processor, the decoded difference signal by an operation of the decoded difference signal and a coefficient corresponding to the detected variation over time; and computing, using a computing section including a processor, a decoded stereo signal from the decoded monaural signal and the decoded difference signal subjected to smoothing, wherein the detecting detects, as the variation over time, that a frame including the encoded difference signal is changed to a frame not including the encoded difference signal or that a frame not including the encoded different signal is changed to a frame including the encoded difference signal.

* * * * *